US007159428B2

(12) United States Patent
Rieck et al.

(10) Patent No.: US 7,159,428 B2
(45) Date of Patent: Jan. 9, 2007

(54) PRE-BEADING METHOD AND APPARATUS

(75) Inventors: Leland M. Rieck, Palo, IA (US); John M. Zlatohlavek, Cedar Rapids, IA (US)

(73) Assignee: Met-Coil Systems Corporation, Westfield, MA (US)

( * ) Notice: Subject to any disclaimer, the term of this patent is extended or adjusted under 35 U.S.C. 154(b) by 215 days.

(21) Appl. No.: 10/914,696

(22) Filed: Aug. 7, 2004

(65) Prior Publication Data

US 2005/0072203 A1 Apr. 7, 2005

Related U.S. Application Data

(60) Provisional application No. 60/493,424, filed on Aug. 7, 2003.

(51) Int. Cl.
*B21C 37/29* (2006.01)

(52) U.S. Cl. ..... 72/71; 72/70; 72/112; 72/118; 72/125

(58) Field of Classification Search ..... 72/70, 72/71, 72, 102, 107, 112, 115, 117, 118, 120, 72/125

See application file for complete search history.

(56) References Cited

U.S. PATENT DOCUMENTS

| | | | | |
|---|---|---|---|---|
| 3,348,403 | A | 10/1967 | Bartley | |
| 3,595,056 | A | 7/1971 | Hutton | |
| 3,648,500 | A * | 3/1972 | Vaill | 72/71 |
| 3,648,503 | A * | 3/1972 | Harper | 72/84 |
| 5,319,952 | A | 6/1994 | Cadney | |
| 5,829,294 | A | 11/1998 | Bradbury et al. | |
| 6,378,184 | B1 * | 4/2002 | Bota | 29/33 K |

* cited by examiner

*Primary Examiner*—Ed Tolan
(74) *Attorney, Agent, or Firm*—McCormick, Paulding & Huber LLP

(57) ABSTRACT

A pre-beading apparatus for fashioning a cylindrical includes a housing have a work surface and an aperture formed in the work surface, where the aperture is capable of accommodating the cylindrical workpiece. A rotatable head assembly is concentrically aligned with the aperture, and includes a bead wheel and a cut wheel disposed on opposing distal ends of the rotatable head assembly. A gripper assembly is disposed within the housing and includes a securing means that extends into the cylindrical workpiece and permits selective movement of the cylindrical workpiece in an axial direction.

18 Claims, 9 Drawing Sheets

PRE-BEADING METHOD AND APPARATUS

CROSS REFERENCE TO RELATED APPLICATIONS

This application is entitled to the benefit of U.S. Provisional Application No. 60/493,424, filed Aug. 7, 2003, herein incorporated by reference in its entirety.

FIELD OF THE INVENTION

This invention relates, in general, to a duct forming apparatus for use with metallic workpieces, and deals more particular with a pre-beading apparatus for use with metal duct workpieces.

BACKGROUND OF THE INVENTION

Ducts are extensively utilized in heating, cooling and ventilating systems to distribute heated or cooled air throughout a structure. These ducts are commonly formed from differing gauges of sheet metal in sections of predetermined lengths which are then connected to one another to form a continuous duct system for distributing air.

It is oftentimes necessary to connect two sections of duct utilizing a corner duct section to accommodate changes in the direction of the duct. These corner sections may exhibit a 90°, 45°, 30° or any other change in direction.

It is known in the art that when cylindrical ducts having circular cross-sections are utilized, an elbow rotator apparatus may be employed to rotate the differing sections of a formed, cylindrical duct so as to define the appropriate corner duct section. One example of such an elbow rotator is disclosed in commonly assigned and pending U.S. patent application Ser. No. 10/744,279, entitled ELBOW ROTATOR and filed on Dec. 23, 2003, herein incorporated by reference in its entirety.

Although elbow rotators for cylindrical duct section are known, these apparatuses are only employed after a straight, cylindrical duct workpiece is cut and formed. Elbow forming apparatuses are also known in the art to accomplish the cutting and formation a straight, cylindrical duct workpiece, however the known elbow forming apparatuses suffer from certain drawbacks.

In particular, known elbow formation apparatuses are capable of holding a straight, cylindrical duct workpiece so that a series of cuts may be made in the workpiece to define thereby the sections of the workpiece that may be subsequently rotated to form a corner duct section. A series of beads may also be formed in the workpiece, in the area of each cut, so that adjacent sections of the corner duct nest within one another, thus providing a formed joint capable of permitting rotation about the center, longitudinal axis of the workpiece.

Known elbow formation apparatuses, however, first cut the cylindrical duct workpiece, and then impart a bead to the recently separated section of the workpiece to facilitate the nested mating of the two sections. In performing the cutting operation first, that is, performing the first cut prior to the formation of a bead, known elbow formation apparatuses suffer from the shaving of slivers of metal caused by the falling of the top cylindrical duct section into the path of the cutting die of the elbow formation apparatuses. Such problems are exasperated when the cylindrical duct workpiece is formed from thin gauge metal.

With the forgoing problems and concerns in mind, it is the general object of the present invention to provide a pre-beading apparatus for use with metal duct workpieces which avoids the formation of metal slivers, and promotes the more efficient manufacture of elbow duct sections.

SUMMARY OF THE INVENTION

It is an object of the present invention to provide a pre-beading apparatus for use with metal duct workpieces.

It is another object of the present invention to a pre-beading apparatus for use with metal duct workpieces that performs a beading operation prior to accomplishing any cuts in the workpiece.

It is another object of the present invention to provide a pre-beading apparatus for use with metal duct workpieces that prevents the improper shaving of slivers of metal when cutting the workpiece.

It is another object of the present invention to provide a method for utilizing a pre-beading apparatus that can compensate for the rotation of the bead die during formation of a bead.

In accordance, therefore, with one embodiment of the present invention, a pre-beading apparatus for fashioning a cylindrical includes a housing have a work surface and an aperture formed in the work surface, where the aperture is capable of accommodating the cylindrical workpiece. A rotatable head assembly is concentrically aligned with the aperture, and includes a bead wheel and a cut wheel disposed on opposing distal ends of the rotatable head assembly. A gripper assembly is disposed within the housing and includes a securing means that extends into the cylindrical workpiece and permits selective movement of the cylindrical workpiece in an axial direction.

These and other objectives of the present invention, and their preferred embodiments, shall become clear by consideration of the specification, claims and drawings taken as a whole.

DETAILED DESCRIPTION OF THE PREFERRED EMBODIMENT

Figure 1:
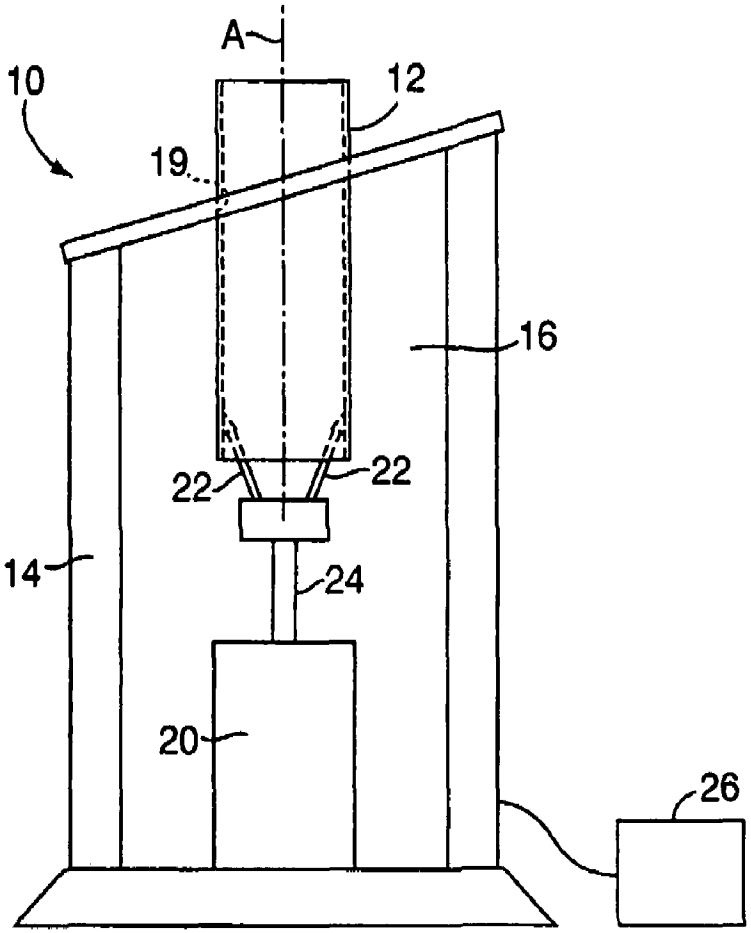
FIG. 1 illustrates a partial cross sectional view of a pre-beading apparatus, in accordance with one embodiment of the present invention.

FIG. 1 illustrates an elbow formation apparatus 10 for use in forming separate, yet nested, sections in a cylindrical duct workpiece 12, in accordance with one embodiment of the present invention. As shown in FIG. 1 the elbow formation apparatus 10 includes a housing 14 that defines an inner compartment 16, within which various components are housed. An inclined work surface 18 is arranged on the top portion of the elbow formation apparatus 10. While the inclined work surface 18 shown in FIG. 1 is preferably disposed at an angle of approximately 15°, the present invention is not limited in this regard as other angles of inclination may also be utilized without departing from the broader aspects of the present invention.

Once the cylindrical workpiece 12 has been inserted through a central aperture 19 in the inclined work surface (shown in detail in FIG. 2), a gripper assembly 20 is actuated such that gripper arms 22 are expanded within the cylindrical workpiece 12 so as to securely hold the cylindrical workpiece 12 during a pre-beading and cutting operation. As will be explained in more detail later, the gripper assembly 20 includes a pneumatic, hydraulic or electric cylinder arrangement 24 which may be selectively controlled so as to index the cylindrical workpiece 12 in a direction substantially parallel to a longitudinal axis A of the cylindrical workpiece 12.

A command and control station 26 is also diagrammatically shown in FIG. 1. The command and control station 26 includes computer hardware and software which enables the command and control station 26 to control the operation of the elbow formation apparatus 12 in a manner consistent with the input by an operator. The command and control station 26 is diagrammatically shown as being separate from the housing 14 for the purposes of clarity, however the present invention is not limited in this regard. Indeed, in the preferred embodiment of the present invention, the command and control station 26 is integrated with the housing 14 such that the computer hardware and software is contained therein. Moreover, manually operable control dials, knobs and switches for controlling the operation of the elbow formation apparatus 10, and for issuing commands to the command and control station 26 towards this end, may be located on the housing 14, and/or on the inclined work surface 18, for the convenience of en operator.

Figure 2:
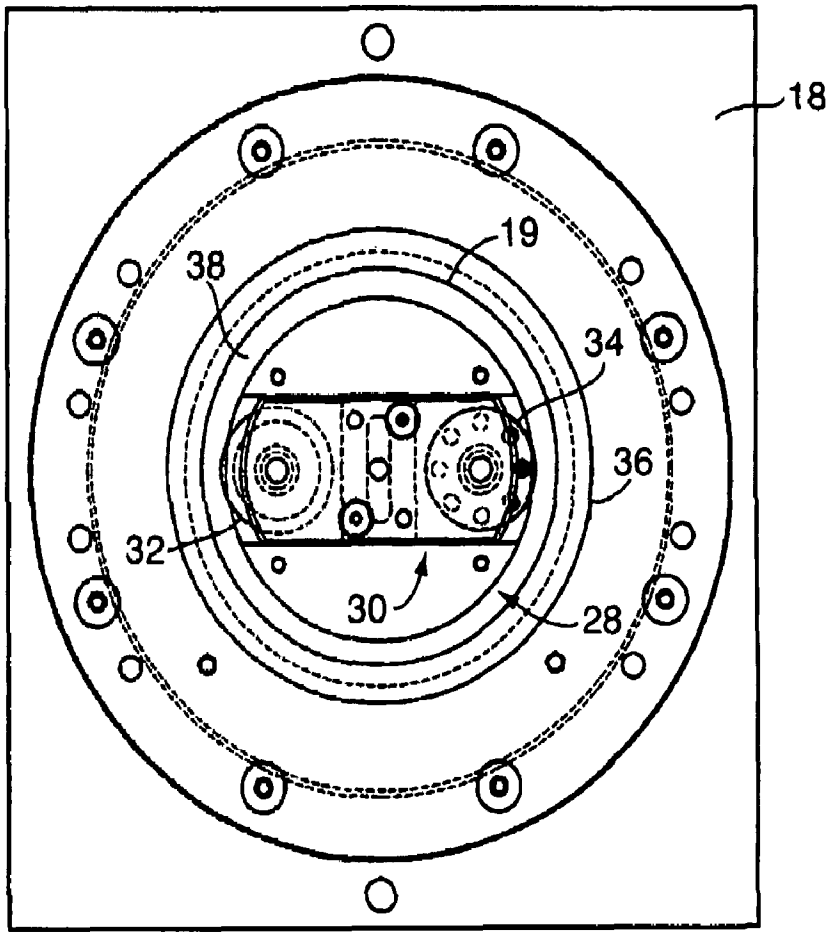
FIG. 2 illustrates a top, planar view of an inclined work surface of the pre-beading apparatus of FIG. 1.

Turning now to FIG. 2, the inclined work surface 18 and the central aperture 19 are more clearly shown. As depicted in FIG. 2, a formation head 28 is concentrically aligned with the central aperture 19 and is mounted onto a known arbor mechanism which selectively enables the head 28 to rotate in either a first, clockwise direction, or in a second, counter-clockwise direction.

The head 28 itself movably supports a sliding block assembly 30 thereon. The sliding block assembly 30 includes a bead wheel 32 and a cut wheel 34, disposed on opposing distal ends thereof. Also operatively associated with the sliding block assembly 28 is a series of gears and eccentric pin arrangements which, as will be described in more detail later, causes the bead wheel 32 and the cut wheel 34 to incrementally shift outward in a radial direction upon either the reverse, or forward, movement, respectively, of the head 28.

The gears and eccentric pin arrangements are designed such that for every predetermined number of revolutions of the head 28, the bead wheel 32 and the cut wheel 34 are designed to incrementally index outward in the radial direction. That is, rotation of the head 28 causes the shifting of the sliding block assembly 30, such that the bead wheel 32 or the cut wheel 34 is selectively shifted to index in a direction towards the inner surface of the cylindrical workpiece 12. In the preferred embodiment of the present invention, it is the bead wheel 32 that is designed to initially shift incrementally and radially outwards during the reverse (counter-clockwise) rotation of the head 28, and the cut wheel 34 that is designed to initially shift incrementally and radially outwards during the forward (clockwise) rotation of the head 28.

It will be readily appreciated that either the bead wheel 32 or the cut wheel 34 may be designed to extend radially upon either directional rotation of the head 28 without departing from the broader aspects of the present invention. Moreover, while the specific gearing and eccentric pin arrangements are only diagrammatically shown in FIG. 2, it will also be readily appreciated that any known gearing arrangement may be utilized, provided that the selective actuation and extension of the bead wheel 32 and the cut wheel 34 is accomplished in accordance with the present invention.

It should also be noted that due to the nature of the eccentric pin and gear arrangement, the movement of the sliding block assembly 30 will change directions should revolution of the head 28 continue beyond a predetermined number of revolutions. That is, although the sliding block assembly 30 is initially shifted so as to radially extend the bead wheel 32 during reverse (counter-clockwise) rotation, the continued rotation of the sliding block assembly 30 in the reverse direction will eventually cause the sliding block 30 to return to, and extend through, its home position, and thereafter cause the cut wheel 34 to be shifted radially towards the wall of the cylindrical workpiece 12.

Returning to FIG. 2, a clamp and bead die 36 is shown as being arranged about the circumference of the central aperture 19 and provides the bearing surface against which the cylindrical workpiece 12 is pressed during formation by the bead wheel 32 and the cut wheel 34, as will be explained in more detail in connection with FIGS. 3–5. As is also shown in FIG. 2, an annular loading space 38 is defined between the head 28 and the clamp and bead die 36 for accommodating the loading of the cylindrical workpiece 12.

Figure 3:
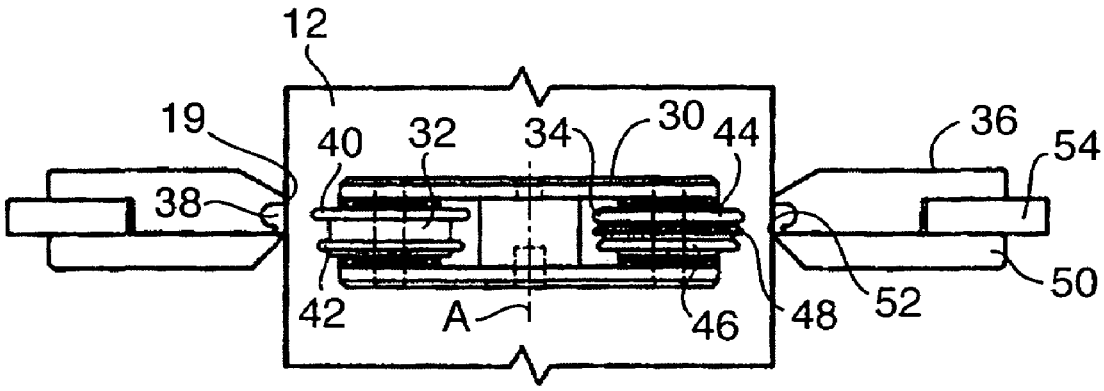
FIG. 3 illustrates a sliding block assembly, for supporting a bead wheel and a cut wheel, in its home position.
Figure 4:
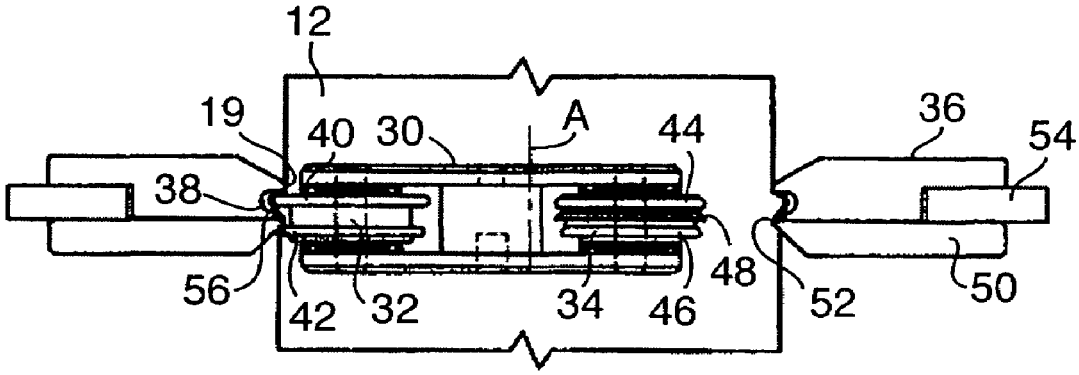
FIG. 4 illustrates the sliding block assembly of FIG. 3 in a bead formation position.

As is shown in FIG. 3, the cylindrical workpiece 12 is first mounted through the central aperture 19, in the annular loading space 38 between the sliding block assembly 30 and the clamp and bead die 36. When initially loaded, the cylindrical workpiece 12 is secured at the bottom portion thereof via the gripper assembly 20, thus prohibiting any non-instructed axial movement of the cylindrical workpiece 12. Prior to any actuation by the operator, the sliding block assembly 30 is disposed at its center, home position, in which neither the bead wheel 32 nor the cut wheel 34 is yet in contact with the inner wall of the cylindrical workpiece 12.

As is also shown in FIG. 3, the bead wheel includes upper and lower bead dies, 40 and 42 respectively, while the cut wheel 34 also includes an upper bead die 44 and a lower deformation die 46 disposed on either side of a cutting knife 48. A cut ring 50 is disposed beneath the clamp and bead die 36 and provides a cutting edge 52 in registration with the cutting knife 48, as will be explained in more detail later. A clamp plate 54 is utilized to secure the clamp and bead die 36 against the outer surface of the cylindrical workpiece 12, thus also arresting any non-instructed axial movement of the cylindrical workpiece 12.

Upon operation of the present invention, the operator, via the command and control station/system 26, instructs the arbor to rotate the head 28 in a reverse, or counter-clockwise direction. As this rotation occurs, the eccentric pin and gear arrangement causes sliding block assembly 30 to incrementally shift in a direction substantially perpendicular to the axis A, thereby causing the bead wheel 32 to contact the inner surface of the cylindrical workpiece 12. As shown in FIG. 4, as the head 28 is rotated, and as the bead wheel 32 is continued to be incrementally shifted in a radial direction, the upper bead die 40 of the bead wheel 32 deforms the wall of the cylindrical workpiece 12 into the clamp and bead die 36 such that a pre-bead 56 is formed in the wall of the cylindrical workpiece 12. As indicated previously, the depth that the bead wheel 32 extends into the clamp and bead die 36, and thus the size of the pre-bead 56, is controlled by the number of revolutions of the head 28.

It is therefore an important aspect of the present invention that a pre-beading operation is accomplished by the bead wheel 32 prior to a cutting operation being accomplished by the cut wheel 34. In doing so, the present invention does not suffer from the prior art problems of slippage of the cylindrical workpiece 12 following a cutting operation.

That is, as the pre-bead 56 is formed, metal from the cylindrical workpiece 12 is deformed and, to a certain extent, pulled downward into the clamp and bead die 36. The pre-bead 56 so formed not only helps to stiffen the top portion of the cylindrical workpiece 12 but, once the top portion of the cylindrical workpiece 12 has been cut away from the bottom portion, the pre-bead 56 also prevents the top portion from sliding downwards and into the path of the cut wheel 34. Thus, the advent of slippage and the corresponding metal shavings from the bottom portion of the cylindrical workpiece 12 is effectively avoided. As utilized herein, the terms 'top portion' and 'bottom portion' refer to that portion of the cylindrical workpiece 12 which is either above or below the cutting plane of the cut wheel 34, respectively.

Once the pre-beading operation is completed, the operator, via the command and control station/system 26, instructs the arbor to rotate the head 28 in a forward, or clockwise direction. As this rotation occurs, the eccentric pin and gear arrangement causes sliding block assembly 30 to incrementally shift in a direction substantially perpendicular to the axis A, thereby causing the cut wheel 34 to contact the inner surface of the cylindrical workpiece 12. As shown in FIG. 5, as the head 28 is rotated in the forward direction, and as the cut wheel 32 is continued to be incrementally shifted in a radial direction, the cutting edge 52 of the cut ring 50 acts in association with the cutting knife 48 to cut and separate the top portion of the cylindrical workpiece 12 from the bottom portion.

Figure 5:
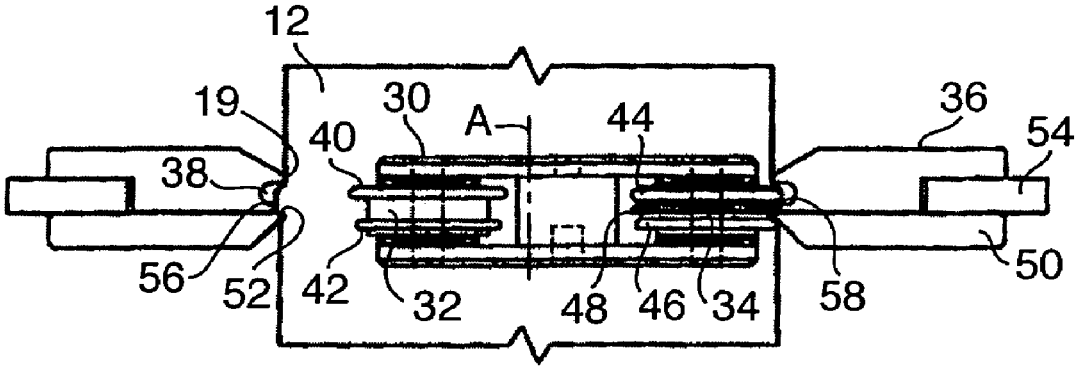
FIG. 5 illustrates the sliding block assembly of FIG. 3 in a cut formation position.

As will be appreciated, during the cutting operation by the cutting knife 48, the cutting knife 48 deforms the bottom edge of the top portion of the cylindrical workpiece 12 out under the lower lip 58 of the clamp and bead die 36, as shown in FIG. 5. Moreover, the lower deformation die 46 acts in concert with the cutting edge 52 to deform the top of the bottom portion of the cylindrical workpiece 12 inwards towards the axis A, thus facilitating the subsequent nesting of the bottom portion into the top portion of the cylindrical workpiece 12. Also during the cutting operation, the upper bead die, or lobe, 44 of the cut wheel 34 continues to deform the wall of the cylindrical workpiece 12 out into the clamp and bead die 36, in the same area of the pre-bead 56.

It is therefore another important aspect of the present invention that not only does the formation of the pre-bead 56 prior to a cutting operation eliminate the possibility that the top portion of the cylindrical workpiece 12 will slip downwards into the plane of the cutting knife 48, but the pre-bead 56 also ensures that the cutting operation does not deform the cylindrical workpiece in a negative manner. That is, without the previous formation of the pre-bead 56, the upper lobe 44 would act on the wall of the cylindrical workpiece 12 such that the material of the cylindrical workpiece 12 may be pulled upwards, thus reducing the amount of the top portion of the cylindrical workpiece 12 that is deformed out under the lower lip 58 of the clamp and bead die 36. Should this occur, as it oftentimes does when utilizing prior art devices, the room available to nestingly mate the bottom portion into the top portion is reduced, and may accordingly catch and deform the edges of the top and bottom portions, ruining the parts.

Thus, it will be readily appreciated that while having an upper lobe 44 is desirous for the purposes of flaring out the bottom of the top portion of the cylindrical workpiece 12 to promote nesting, the prior creation of the pre-bead 56 not only assists in this regard, but prevents an undesirable deformation of the edges of the top and bottom portions of the cylindrical workpiece 12.

As mentioned previously, the proposed pre-beading method and apparatus is most helpful especially when utilizing thin-gauge material, which is typically harder to keep properly formed and harder to hold in the apparatus during a cutting operation. A switch, or other manually operable contact, may be incorporated into the command and control station/system 26 in order to by-pass the pre-beading operation when processing thicker-gauge material, or when it is simply not desired.

Once the pre-bead 56 and the cut is accomplished, the cylinder arrangement 24 is actuated to cause the bottom portion of the cylindrical workpiece 12 to move upwards and nest, or breed, within the top portion. As the head 28 had previously been moving in the clockwise direction during the cutting operation, the continuation of the rotation of the head 28 in the clockwise direction causes the bead wheel 32 to again shift radially and urge the deformed upper lip of the bottom portion to be nested within the pre-bead 56, thus completing the beaded joint between the top and bottom portions of the cylindrical workpiece 12. As will be appreciated, repeated operation of these steps will result in a complete elbow duct to be formed without slippage, metal shavings or undesired deformation of the cylindrical workpiece 12.

The flow diagrams of FIGS. 6–12 will now be discussed. As indicated hereinafter, the flow diagrams of FIGS. 6–12 detail one embodiment of an operational program capable of being implemented by the command and control station/system 26 of the present invention.

Figure 6:
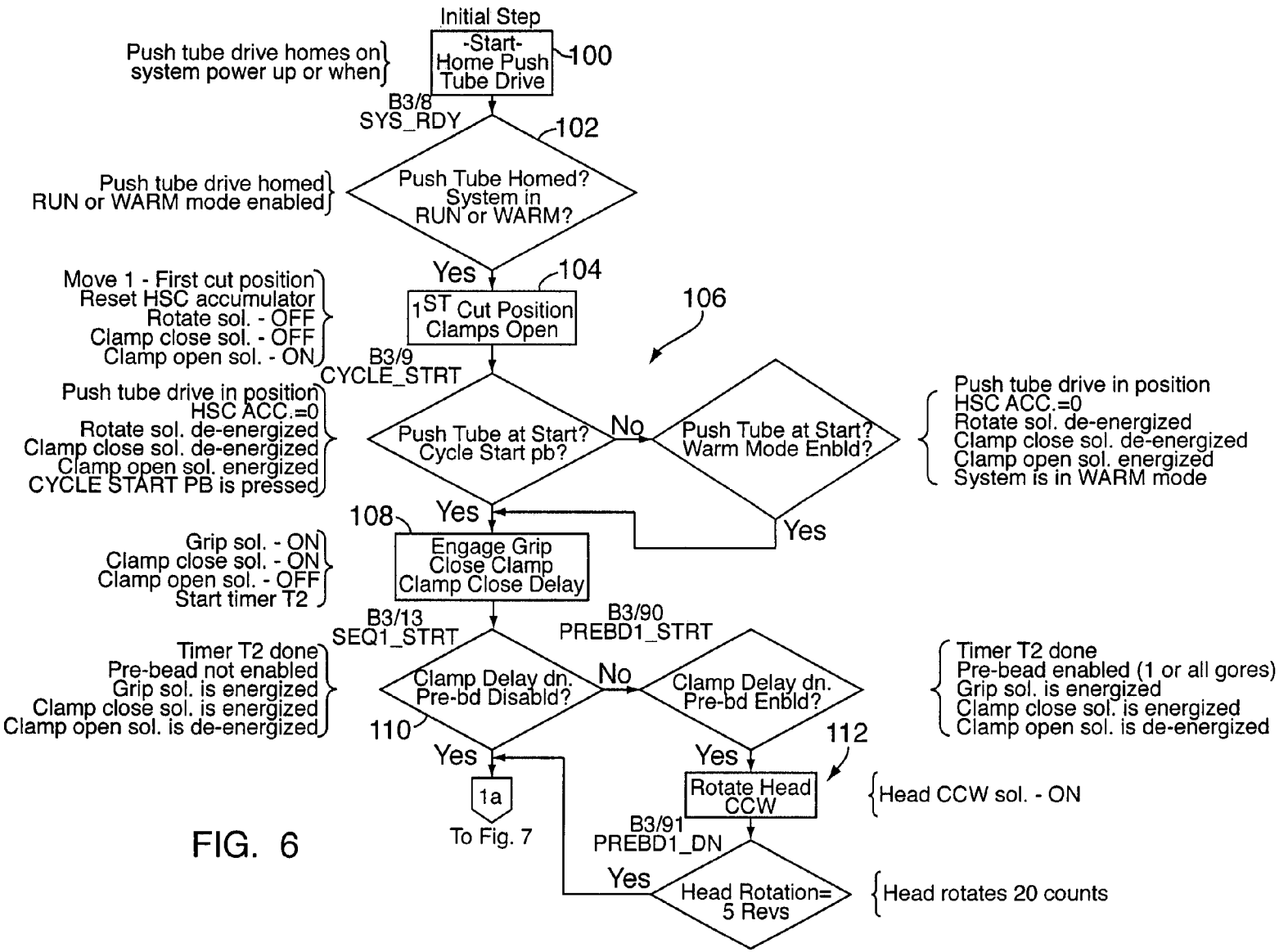
FIGS. 6–12 illustrate one embodiment of an operational program capable of being implemented by the command and control station/system of the present invention.

As shown in FIG. 6, the pre-beading apparatus of the present invention is first enabled by turning the power to the apparatus 'on' in step 100. The system is warmed up in step 102 and the clamp plate 54 is opened to accept the cylindrical workpiece 12, in step 104. Confirmation that the cylindrical workpiece 12 is loaded into the annular loading space 38 is accomplished in step 106, and the clamp plate 54 is closed to secure the cylindrical workpiece 12, in step 108.

Figure 7:
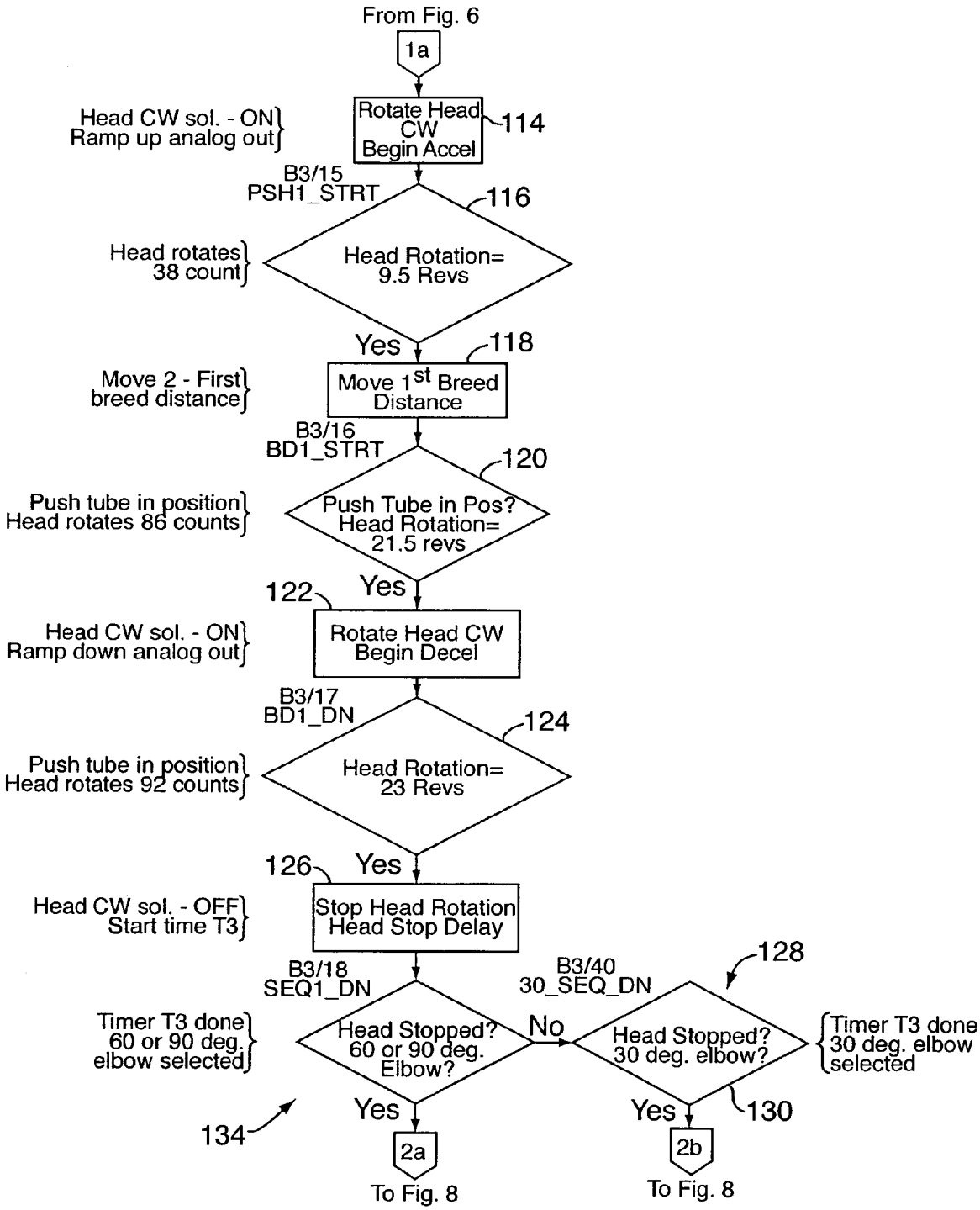
Figure 8:
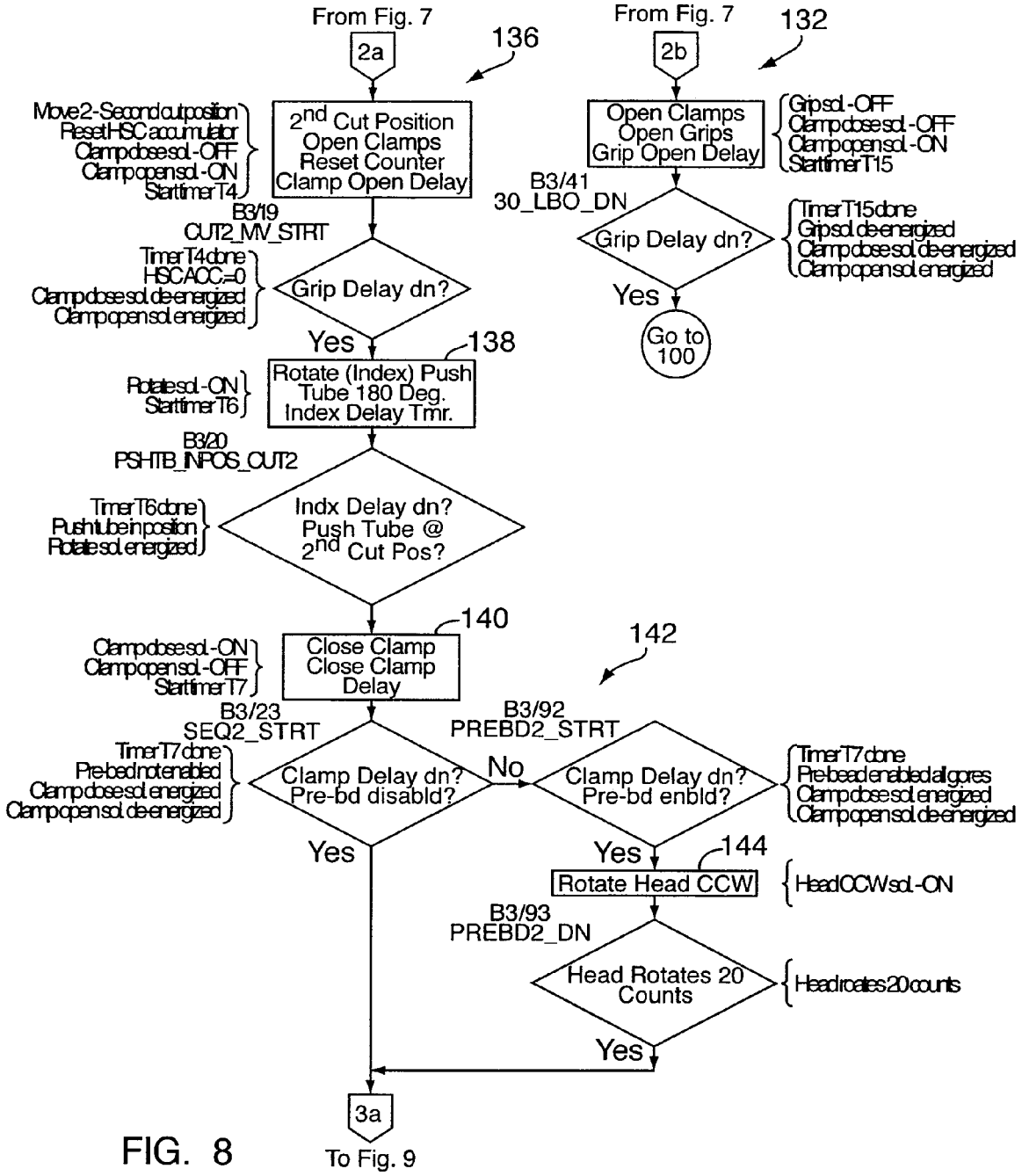

It is determined if the pre-beading operation is disabled in step 110, and if not, the head 28 is directed to rotate in a counter-clockwise direction so as to shift the bead wheel 32 into engagement with the wall of the cylindrical workpiece 12, in step 112. Turning now to FIG. 7, once the pre-beading operation has been accomplished via the counter-clockwise rotation of the head 28 for a predetermined number of rotations, the head 28 is directed to rotate in a clockwise direction, in step 114, (for the predetermined number of rotations as indicated in step 116) to effect the utilization of the cut wheel 34 and the cutting of the cylindrical workpiece 12.

Upon completion of the cutting operation, the cylinder arrangement 24 is actuated to move the bottom portion of the cylindrical workpiece 12 upwards a first breed distance, in step 118, thus nesting the bottom portion into the pre-beaded top portion. The head 28 continues to rotate in the clockwise direction for a predetermined number of rotations, in step 120, so that the eccentric pin and gear assembly will then cause the bead wheel 32 to again be shifted radially outwards such that continued clockwise rotation, in step 122, causes the bead dies, 40 and 42, to urge the deformed upper lip of the bottom portion to be nested within the pre-bead 56, thus completing the beaded joint between the top and bottom portions of the cylindrical workpiece 12. The bead dies, 40 and 42, are rotated a predetermined number of rotations, in step 124, prior to the head coming to a stop at step 126.

At this juncture, as indicated in FIG. 7, a decision is made as to the angle of the elbow duct that is desired to be formed, in step 128. If, as indicated in step 130, a 30° elbow is desired, the control system moves to step 132, shown in FIG. 8, where the clamp plate 54 is opened, the cylindrical workpiece 12 may be removed and the system returns to step 100, the start. If, however, as indicated in step 134, a 60° or 90° elbow is desired, the control system moves to step 136, shown in FIG. 8, where the clamp plate 54 is opened, the cylindrical workpiece 12 is rotated 180° (in step 138) and the clamp plate 54 is again closed in step 140.

Figure 9:
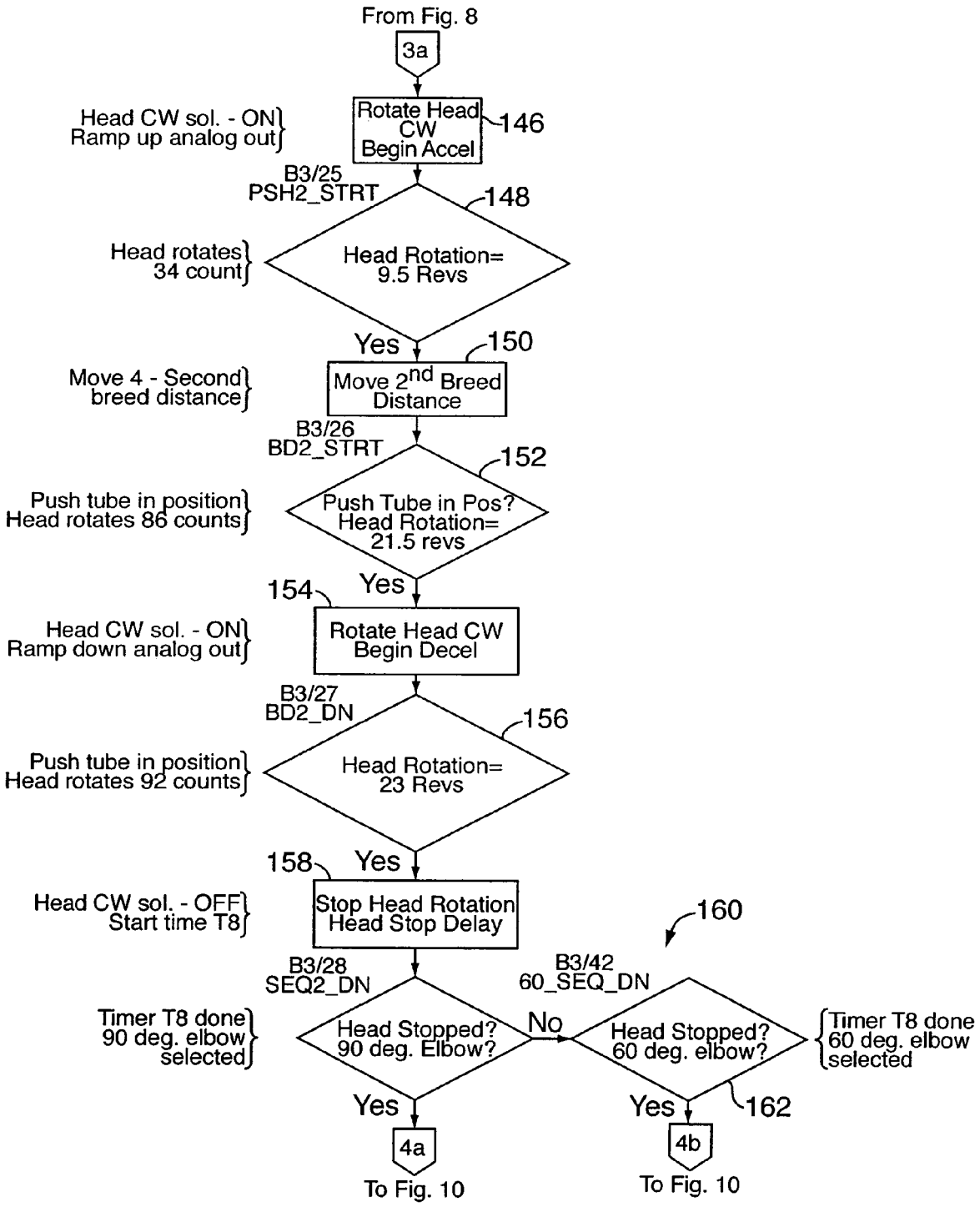
Figure 10:
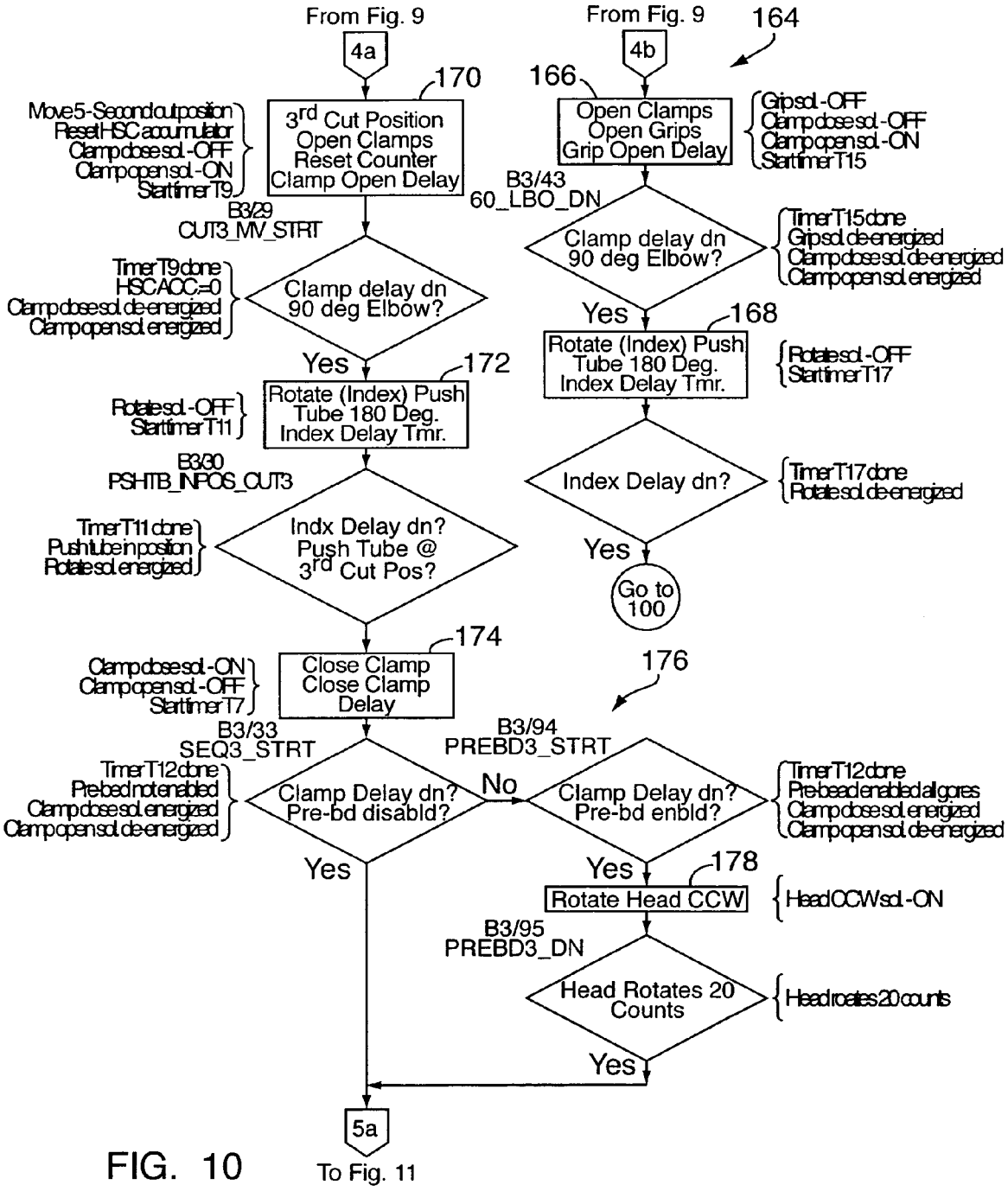

It is again determined if the pre-beading operation is disabled in step 142, and if not, the head 28 is directed to rotate in a counter-clockwise direction so as to again shift the bead wheel 32 into engagement with the wall of the cylindrical workpiece 12, in step 144. Turning now to FIG. 9, once the pre-beading operation has been accomplished via the counter-clockwise rotation of the head 28 for a predetermined number of rotations, the head 28 is directed to rotate in a clockwise direction, in step 146, (for the predetermined number of rotations as indicated in step 148) to effect the utilization of the cut wheel 34 and the cutting of the cylindrical workpiece 12.

Upon completion of the cutting operation, the cylinder arrangement 24 is actuated to move the bottom portion of the cylindrical workpiece 12 upwards a second breed distance, in step 150, thus nesting the bottom portion into the pre-beaded top portion. The head 28 continues to rotate in the clockwise direction for a predetermined number of rotations, in step 152, so that the eccentric pin and gear assembly will then cause the bead wheel 32 to again be shifted radially outwards such that continued clockwise rotation, in step 154, causes the bead dies, 40 and 42, to urge the deformed upper lip of the bottom portion to be nested within the pre-bead 56, thus completing the beaded joint between the top and bottom portions of the cylindrical workpiece 12. The bead dies, 40 and 42, are rotated a predetermined number of rotations, in step 156, prior to the head coming to a stop at step 158.

At this juncture, as indicated in FIG. 9, a decision is again made as to the angle of the elbow duct that is desired to be formed, in step 160. If, as indicated in step 162, a 60° elbow is desired, the control system moves to step 164, shown in FIG. 10 where the clamp plate 54 is opened (in step 166), the cylindrical workpiece 12 is rotated 180° (in step 168) and the cylindrical workpiece 12 may be removed and the system returns to step 100, the start. If, however, as indicated in step 160, a 90° elbow is desired, the control system moves to step 170, shown in FIG. 10, where the clamp plate 54 is again opened, the cylindrical workpiece 12 is rotated 180° (in step 172) and the clamp plate 54 is again closed in step 174.

Figure 11:
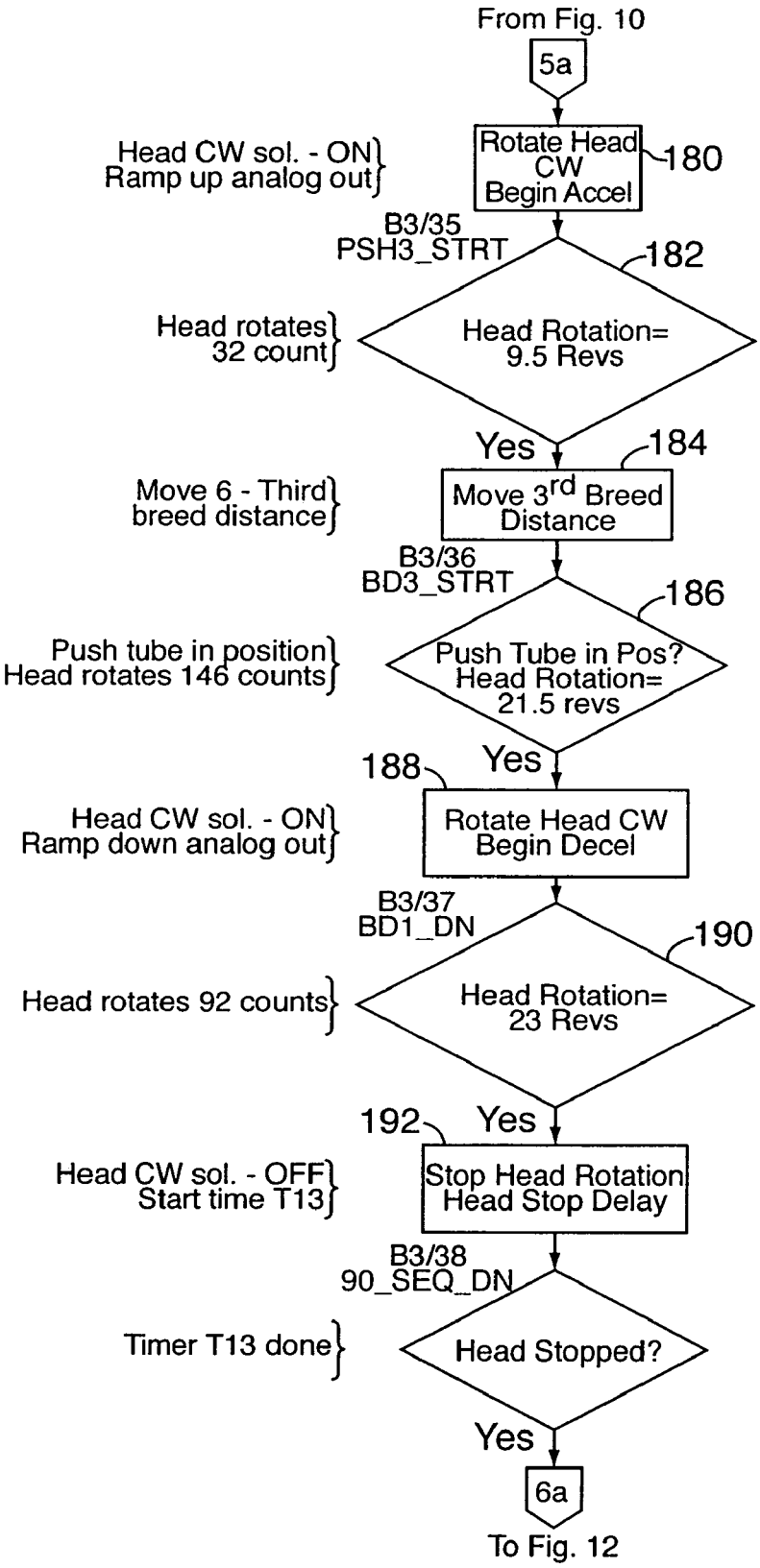

It is again determined if the pre-beading operation is disabled in step 176, and if not, the head 28 is directed to rotate in a counter-clockwise direction so as to again shift the bead wheel 32 into engagement with the wall of the cylindrical workpiece 12, in step 178. Turning now to FIG. 11, once the pre-beading operation has been accomplished via the counter-clockwise rotation of the head 28 for a predetermined number of rotations, the head 28 is directed to rotate in a clockwise direction, in step 180, (for the predetermined number of rotations as indicated in step 182) to effect the utilization of the cut wheel 34 and the cutting of the cylindrical workpiece 12.

Upon completion of the cutting operation, the cylinder arrangement 24 is actuated to move the bottom portion of the cylindrical workpiece 12 upwards a third breed distance, in step 184, thus nesting the bottom portion into the pre-beaded top portion. The head 28 continues to rotate in the clockwise direction for a predetermined number of rotations, in step 186, so that the eccentric pin and gear assembly will then cause the bead wheel 32 to again be shifted radially outwards such that continued clockwise rotation, in step 188, causes the bead dies, 40 and 42, to urge the deformed upper lip of the bottom portion to be nested within the pre-bead 56, thus completing the beaded joint between the top and bottom portions of the cylindrical workpiece 12. The bead dies, 40 and 42, are rotated a predetermined number of rotations, in step 190, prior to the head coming to a stop at step 192.

Figure 12:
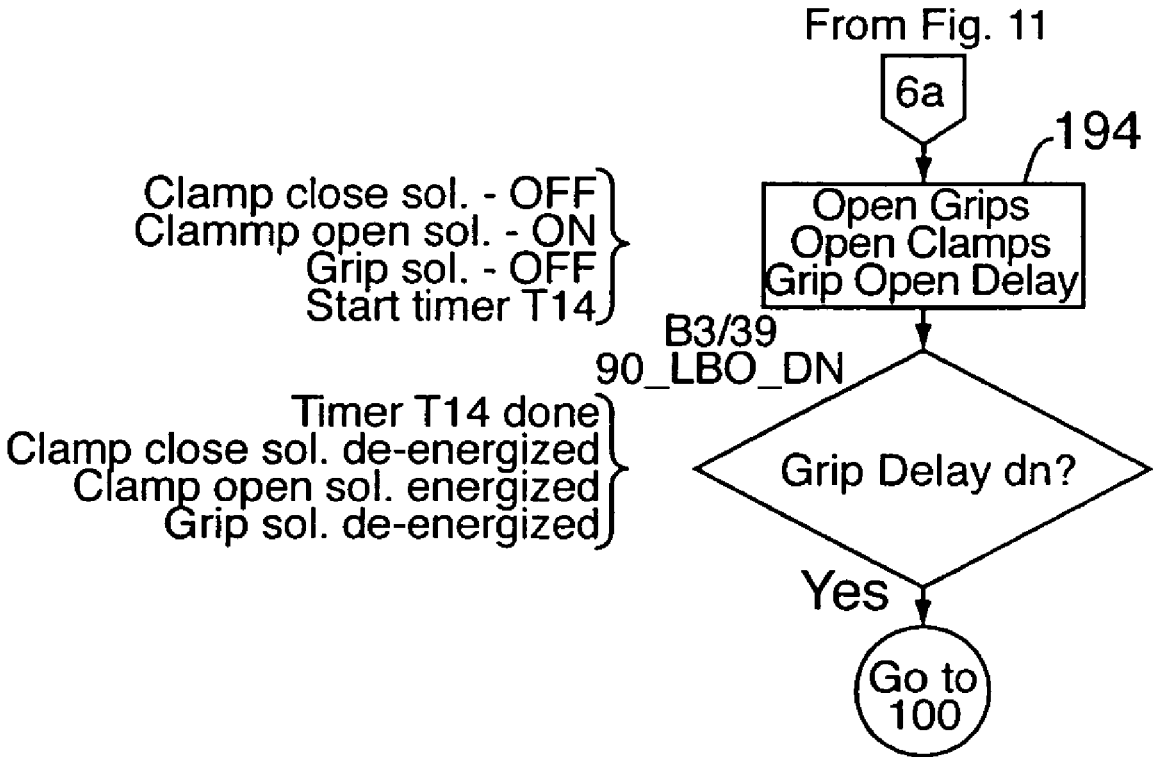

The control system then moves to step 194, shown in FIG. 12, where the clamp plate 54 is opened, and the cylindrical workpiece 12 may be removed and the system returns to step 100, the start.

As will be appreciated by a review of FIGS. 6–12 in total, the control system of the present invention alternatively permits the pre-beading of the first gore, or cut, only, or the pre-beading of two or three gores, in accordance with the angle desired for the elbow duct section. Of course, it will also be readily appreciated that the control system disclosed in FIGS. 6–12 also permits no pre-beading, as well as more than two pre-beading operations to take place.

As also indicated earlier, given that the shifting direction of the sliding block assembly 30 is dependent upon the direction of rotation imparted to the head 28, and the number of rotations of the head 28, it is vitally important that the sliding block assembly 30 is properly centered upon the head 28 prior to the start of any pre-beading or cutting cycle. It is therefore another important aspect of the present invention that an operator may compensate for any excessive, or diminutive, rotation of the head 28 by inputting a compensatory number into the control system such that the head 28 will be rotated in accordance with the compensatory number to thereby proper align the head 28 prior to the beginning of any cycle. This ensures that the correct number of rotations, and correct orientation of the head 28, can be assuredly accomplished.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A pre-beading apparatus for fashioning a cylindrical workpiece, said pre-beading apparatus comprising:

a housing have a work surface;

an aperture formed in said work surface, said aperture being capable of accommodating said cylindrical workpiece;

a rotatable head assembly concentrically aligned with said aperture, said head assembly having a bead wheel and a cut wheel disposed on opposing distal ends of said rotatable head assembly; and a gripper assembly disposed within said housing, said gripper assembly including a securing means that extends into and expands against an inner surface of said cylindrical workpiece and permits selective movement of said cylindrical workpiece in an axial direction.

2. The pre-beading apparatus for fashioning a cylindrical workpiece according to claim 1, wherein:

said bead wheel includes an upper and lower bead die.

3. The pre-beading apparatus for fashioning a cylindrical workpiece according to claim 1, wherein:

said cut wheel includes an upper lobe and a lower deformation die disposed on either planar side of a knife element.

4. The pre-beading apparatus for fashioning a cylindrical workpiece according to claim 1, further comprising:

a clamp and bead die disposed about the circumference of said aperture; and said clamp and bead die having an inscribed profile into which said bead wheel deforms a portion of said cylindrical workpiece.

5. The pre-beading apparatus for fashioning a cylindrical workpiece according to claim 1, further comprising:

a clamp plate for securing said cylindrical workpiece in said aperture.

6. The pre-beading apparatus for fashioning a cylindrical workpiece according to claim 4, further comprising:

a cut ring aligned in registration with a knife element when said cylindrical workpiece is mounted in said aperture.

7. A method of operating an elbow formation apparatus for use with a cylindrical workpiece, said elbow formation apparatus having a rotatable head assembly concentrically aligned with an aperture formed in a work surface of said elbow formation apparatus, said head assembly including a bead wheel and a cut wheel disposed on opposing distal ends of said rotatable head assembly, said method comprising the steps of:

loading said cylindrical workpiece into said aperture;

rotating said head assembly in a first direction such that said bead wheel is caused to impact an inner wall of said cylindrical workpiece;

deforming said cylindrical workpiece via a bead die on said bead wheel so as to form a pre-bead;

rotating said head assembly in a second direction such that said cut wheel is caused to contact said inner wall of said cylindrical workpiece, thereby cutting said cylindrical workpiece; and indexing said cylindrical workpiece in a substantially axial direction.

8. The method of operating an elbow formation apparatus according to claim 7, further comprising the steps of:

controlling the number of rotations in said first direction.

9. The method of operating an elbow formation apparatus according to claim 8, further comprising the steps of:

controlling the number of rotations in said second direction, said first direction being different from said second direction.

10. The method of operating an elbow formation apparatus according to claim 7, further comprising the steps of:

inserting a gripper assembly into said cylindrical workpiece when said cylindrical workpiece is loaded into said aperture.

11. The method of operating an elbow formation apparatus according to claim 10, further comprising the steps of:

expanding gripping arms of said gripper assembly so as to secure said cylindrical workpiece.

12. The method of operating an elbow formation apparatus according to claim 7, further comprising the steps of:

including an upper and lower die on said bead wheel, said upper and lower dies each contacting said inner wall of said cylindrical workpiece.

13. The method of operating an elbow formation apparatus according to claim 7, further comprising the steps of:

including an upper lobe and a lower deformation die on said cut wheel, said cut wheel including a knife disposed between said upper lobe and said lower deformation die.

14. A method of operating an elbow formation apparatus for use with a cylindrical workpiece, said elbow formation apparatus having a rotatable head assembly concentrically aligned with an aperture formed in a work surface of said elbow formation apparatus; said method comprising the steps of:

loading said cylindrical workpiece into said aperture;

controlling said rotatable head assembly to rotate in a first direction;

deforming said cylindrical workpiece to form a pre-bead on said cylindrical workpiece during rotation of said rotatable head assembly in said first direction and prior to cutting said cylindrical workpiece;

controlling said rotatable head assembly to rotate in a second direction; and cutting said cylindrical workpiece during rotation of said rotatable head assembly in said second direction.

15. The method of operating an elbow formation apparatus according to claim 14, further comprising the steps of:

positioning a rotatable head assembly to be concentrically aligned with said aperture, said rotatable head assembly including a bead wheel and a cut wheel disposed on opposing distal ends of said rotatable head assembly.

16. The method of operating an elbow formation apparatus according to claim 15, further comprising the steps of:

rotating said head assembly in said first direction such that said bead wheel is caused to impact an inner wall of said cylindrical workpiece; and deforming said cylindrical workpiece via a bead die on said bead wheel so as to form said pre-bead.

17. The method of operating an elbow formation apparatus according to claim 16, further comprising the steps of:

inserting a gripper assembly into said cylindrical workpiece when said cylindrical workpiece is loaded into said aperture.

18. The method of operating an elbow formation apparatus according to claim 17, further comprising the steps of:

expanding gripping arms of said gripper assembly so as to secure said cylindrical workpiece.

* * * * *